United States Patent [19]

Kanemitsu et al.

[11] Patent Number: 4,544,262

[45] Date of Patent: Oct. 1, 1985

[54] TRANSFER STATION ALIGNMENT DEVICE

[75] Inventors: Shinji Kanemitsu, Ichikawa; Yoshikuni Tohyama, Yokohama, both of Japan

[73] Assignee: Canon Kabushiki Kaisha, Tokyo, Japan

[21] Appl. No.: 512,708

[22] Filed: Jul. 11, 1983

[30] Foreign Application Priority Data

Jul. 19, 1982 [JP] Japan ..... 57-125515

[51] Int. Cl.[4] ..... G03G 15/00

[52] U.S. Cl. ..... 355/3 TR; 355/3 SH

[58] Field of Search ..... 355/3 TR, 3 SH, 14 TR; 430/126; 101/DIG. 13; 271/307-313, DIG. 2

[56] References Cited

U.S. PATENT DOCUMENTS

| | | | |
|---|---|---|---|
| 3,685,896 | 8/1972 | Kaupp | 355/3 TR |
| 3,942,888 | 3/1976 | Maksymiak et al. | 355/3 TR |
| 4,190,348 | 2/1980 | Friday | 355/3 TR |
| 4,386,841 | 7/1983 | Wakao et al. | 355/3 DR |

FOREIGN PATENT DOCUMENTS

| | | | |
|---|---|---|---|
| 121060 | 9/1981 | Japan | 355/14 TR |

*Primary Examiner*—A. T. Grimley
*Assistant Examiner*—J. Pendegrass
*Attorney, Agent, or Firm*—Fitzpatrick, Cella, Harper & Scinto

[57] ABSTRACT

A transfer type image formation apparatus is of such a type that a transfer material is placed in close contact with an image bearing member in an image transfer station, and then separated from the image bearing member by separating means after the image on the image bearing member has been transferred onto the transfer material by transferring means, wherein a rotary member is located upstream of the separating means in the direction of movement of the transfer material, the rotary member being adapted to make a rolling contact with the image bearing member such that the image can stably be transferred onto the transfer material.

7 Claims, 10 Drawing Figures

FIG. 1
PRIOR ART
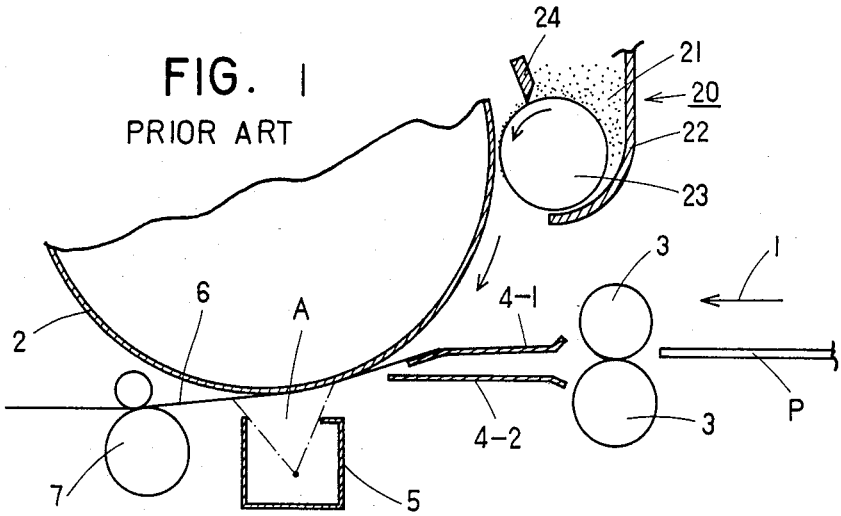
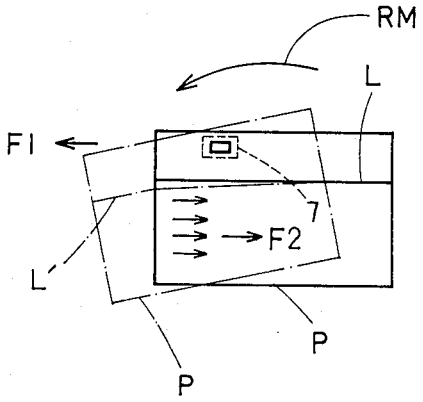
FIG. 2
FIG. 3
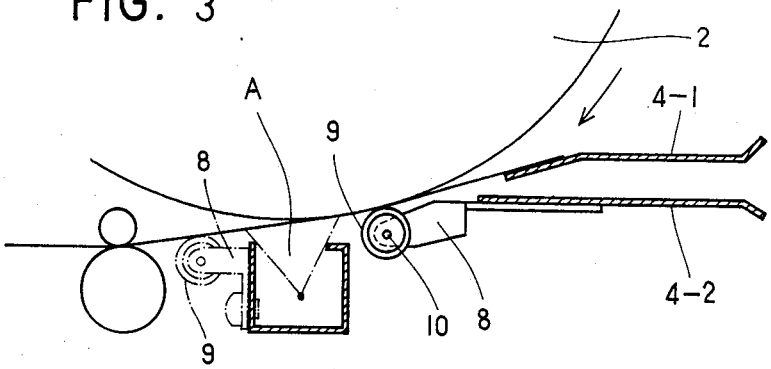

TRANSFER STATION ALIGNMENT DEVICE

BACKGROUND OF THE INVENTION

1. Field of the Invention

The present invention relates to a transfer type image formation apparatus and particularly to an image formation apparatus of such a type that a transfer material is placed in close contact with an image bearing member in an image transferring station wherein the transferring means is disposed opposite to the image bearing member, the transfer material being separated from the image bearing member by the separating means after the image on the image bearing member has been transferred to the transfer material.

2. Description of the Prior Art

A generally known construction carrying out a process from the introduction of the transfer material into the image transferring station to the separation of the same is shown in FIG. 1. A transfer material P in the form of a sheet is fed from a supply of sheets (not shown) in the direction shown by reference numeral 1 in FIG. 1. The transfer material P then moves through the nip between register rollers 3 adapted to bring the transfer material into alignment with an image which has been formed on an image bearing member 2. After passed through the nip between the register rollers 3, the transfer material P is guided by upper and lower transfer guides 4-1 and 4-2 to enter, with a proper angle, an image transferring station in which a transfer charger 5 is located opposite to the image bearing member 2. After the image on the image bearing member has been transferred onto the transfer material P by the transfer charger 5 in the region A of the image transferring station, the transfer material P is separated from the image bearing member by separating means such as a separating belt 6, a separating pawl or the like, and then carried to a paper discharge station by separating rollers 7.

In FIG. 1, reference numeral 20 shows an example of the conventional development device which comprises a hopper 22 containing the toner 21 therein, a toner bearing member 23 located within the hopper 22 to rotate in the direction shown by an arrow, and a toner controlling member 24 for applying the toner on the toner bearing member 23 with a predetermined thickness.

The prior art construction has some disadvantages. When a transfer material P having a reduced size is used, it is held only by the separating rollers 7 after the trailing edge of the transfer material has passed the register rollers 3. The transfer material P is therefore subjected to a moment RM as due to a force F1 which is applied to the transfer material P from the separating rollers 7 and another force F2 produced by the friction between the image bearing member 2 and the separating belt 6 when the transfer material P begins to move. As a result, the transfer material P will be turned during transfer as shown in FIG. 2 to distort the transferred image from its proper position L to an undesirable position L'. Even when a transfer material P having an increased size is utilized, it may be subjected to the above undesirable distortion after the trailing edge thereof has passed the register rollers 3.

SUMMARY OF THE INVENTION

It is an object of the present invention to overcome the above disadvantages in the prior art and to provide an image formation apparatus which can absorb any vibration applied to the transfer material from transporting rollers and others to provide an increased contact of the transfer material with an image bearing member so that a clear image will be formed on the transfer material.

The present invention provides a transfer type image formation apparatus in which a transfer material is introduced into an image transferring station wherein transferring means is located opposite to the image bearing member, the transfer material being then placed in close contact with the image bearing member until the transfer material is separated from the image bearing member by separating means after the image on the image bearing member has been transferred onto the transfer material by the transferring means, and said apparatus being characterized in that a rotary member is disposed upstream of the separating means to make a rolling contact with the image bearing member.

In accordance with the present invention, the rotary member that is, a transfer station roller makes a rolling contact with the image bearing member at the entry of transfer material in the image transferring station in which the transferring means is located opposite to the image bearing member. By using such a simple construction, the transfer material can be controlled to prevent its undesirable motion in the transfer region. There can therefore be eliminated any distortion of the transferred image due to the deviation of the transfer material which may be produced when the transfer material is held only by separating rollers after the trailing edge of the transfer material has passed register rollers. As a result, the transfer material can stably be moved in a linear direction. At the same time, any unstableness in the transfer material can be eliminated during the transferring step since it is forced to contact directly with the image bearing member by means of the above transfer station roller near the transfer region. In such a manner, the present invention provides a transfer type image formation apparatus which is very effective and useful in that a stable image of high quality can always be obtained during transfer.

BRIEF DESCRIPTION OF THE DRAWINGS

FIG. 1 is a schematic view of an image transferring station and surrounding components in the prior art transfer type image formation apparatus;

FIG. 2 is a diagrammatic view illustrating various forces which act on a transfer material;

FIG. 3 is a schematic view of an image transferring station and surrounding components of a transfer type image formation apparatus according to the present invention;

DESCRIPTION OF THE PREFERRED EMBODIMENTS

The present invention will now be described with reference to the preferred embodiments thereof in connection with the drawings.

Figure 4:
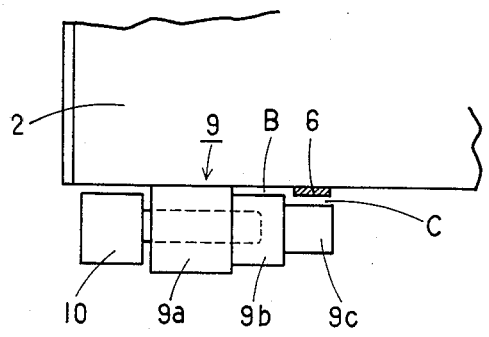
FIG. 4 is a side view showing part of the transfer type image formation apparatus shown in FIG. 3.
Figure 5:
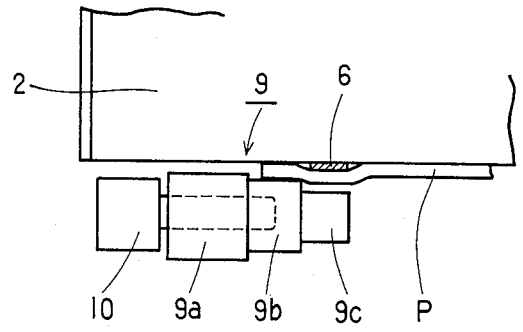
FIG. 5 is a side view similar to FIG. 4, showing a transfer material held between a transfer station roller according to the present invention and an image bearing member.

Referring to FIGS. 3, 4 and 5, a image transferring station comprises a resilient support member 8 fixed to the underside of the lower guide 4-2 and extending toward the image bearing member 2 and a rotary member or transfer station roller 9 rotatably supported on the support member 8 so that the roller 9 is presscontacted to the image bearing member 2 to follow the movement thereof. The transfer station roller 9 includes an increased diameter portion 9*a*, a reduced diameter portion 9*c* and an intermediate diameter portion 9*b* therebetween, all of which portions are formed therein. When the transfer station roller 9 is urged against the image bearing member 2 under the resilience of the support member 8, the increased diameter 9*a* of the transfer station roller 9 will contact the surface of the image bearing member 2 under a substantially constant pressure. On the other hand, the intermediate and reduced diameter portions 9*b* and 9*c* are spaced away from the surface of the image bearing member 2 respectively to form clearances B and C. A separating belt 6 is located within the above clearance C to contact the image bearing member 2.

In the above arrangement, a transfer material P is fed into the gap between the upper and lower guides 4-1 and 4-2 by the register rollers 3. The transfer material P is oriented by the guides 4-1 and 4-2 such that the transfer material will be moved to the image bearing member 2 in a proper orientation. Thereafter, the transfer material P is gripped between the transfer station roller 9 and the image bearing member 2 while contacting with the underside face of the separating belt 6, as shown in FIG. 5. At this time, the transfer material P can easily enter between the transfer station roller 9 and the image bearing member 2 since the former follows the latter. When the transfer material P is being gripped between the transfer station roller 9 and the image bearing member 2, pressure applied to the transfer material P varies depending on the change of the thickness thereof. As the transfer material is increased in thickness, it is brought into less contact with the image bearing member 2, and the image transfer action at the transfer region A is often affected by the behavior of the transfer material in the region other than the transfer region A. If the clearance B between the image bearing member 2 and the intermediate diameter portion 9*b* of the transfer station roller 9 is properly set, pressure can be applied to all of various transfer materials having thicknesses exceeding a predetermined thickness.

The transfer material P is held at two points, i.e., the separating rollers 7 and the transfer station roller 9, so that it moves along a straight line even after the trailing edge of the transfer material P has passed the register rollers 3. In addition, the inner face of the transfer material P will never be stained by contact with the transfer station roller 9, since it contacts the image bearing member 2 at its marginal non-imaged region outward of the separating means such as the separating belt 6 and others.

Figure 6:
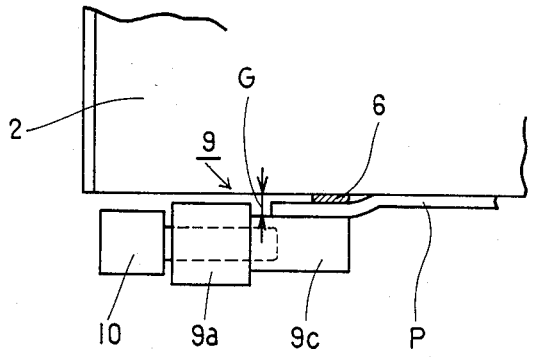
FIG. 6 is a side view of a modification of the transfer station roller in the transfer type image formation apparatus according to the present invention.

As shown in FIG. 6, the transfer station roller 9 may comprise only the increased and reduced diameter portions 9*a* and 9*c* without the intermediate diameter portion 9*b*. In such a case, the transfer material P is gripped between the reduced diameter portion 9*c* of the transfer station roller 9 and the separating belt 6. As in FIGS. 3 and 4, the thickness of the transfer material P can be selected depending on pressure to be applied thereto by properly setting a clearance G between the reduced diameter portion 9*c* of the transfer station roller 9 and the separating belt 6.

The transfer station roller 9 is not necessarily supported by the lower guide 4-2, but may be mounted, for example, on the transfer charger or machine frame through a resilient support member which is adapted to urge the transfer station roller 9 against the image bearing member 2 or the separating belt 6 under a substantially constant pressure.

Figure 7:
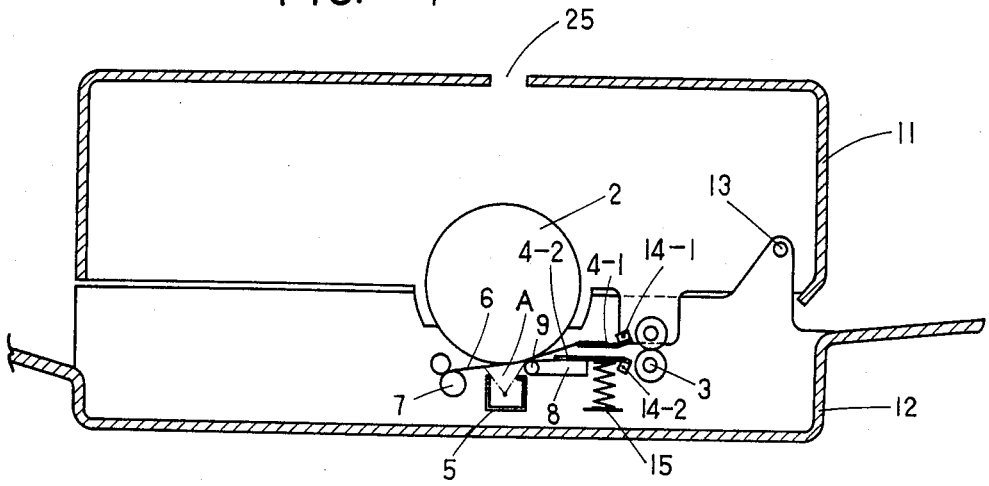
FIG. 7 is a schematic cross section of the transfer type image formation apparatus, according to the present invention, wherein the apparatus is openable, showing the state whereat the apparatus is closed.
Figure 8:
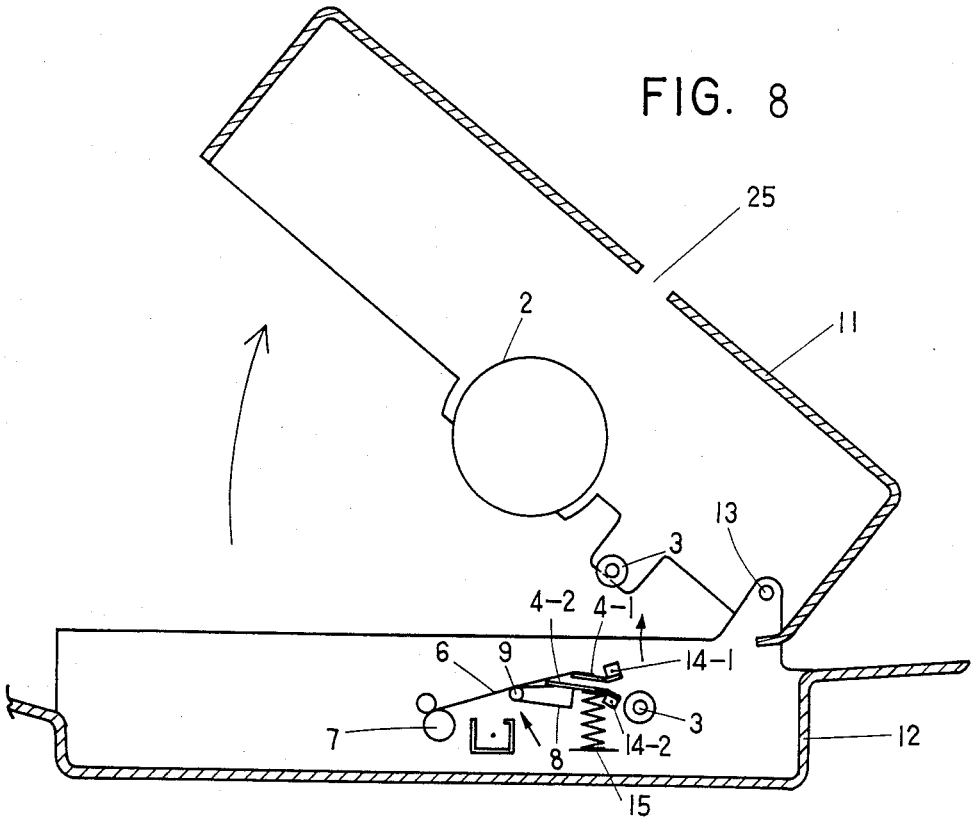
FIG. 8 is a view similar to FIG. 7, showing the apparatus which is opened.

FIGS. 7 and 8 illustrate an image formation apparatus in which a mounting member 11 for the image bearing member 2 is pivotable about a pivot pin 13 to move upwardly away from a mounting member 12 by which the transfer guides 4-1, 4-2 and others are supported. In this arrangement, the transfer guides 4-1 and 4-2 may be pivotably mounted about shafts 14-1 and 14-2, respectively. At the same time, a spring 15 may be located between a fixed part of the mounting member 12 and the lower transfer guide 4-2 to urge the latter upwardly. In this case, the transfer station roller 9 is mounted on a support member 8 which in turn is mounted on the lower transfer guide 4-2. If the mounting member 11 is in its closed position as shown in FIG. 7, the transfer station roller 9 is engaged by the image bearing member 2 under a predetermined pressure while at the same time the image bearing member 2 can properly be positioned relative to the transfer guides 4-1 and 4-2. The mounting member 11 includes an aperture 25 formed therein at the top through which a light image can be transmitted onto the surface of the image bearing member 2.

In the image formation apparatus shown in FIGS. 7 and 8, any suitable means for providing a proper clearance between the image bearing member and the transfer guide may be provided on the lower transfer guide at the opposite end, to the transfer station roller, of the transfer guide, whereby the transfer guides can more exactly be positioned without any undesirable results such as distortion and others.

Figure 9:
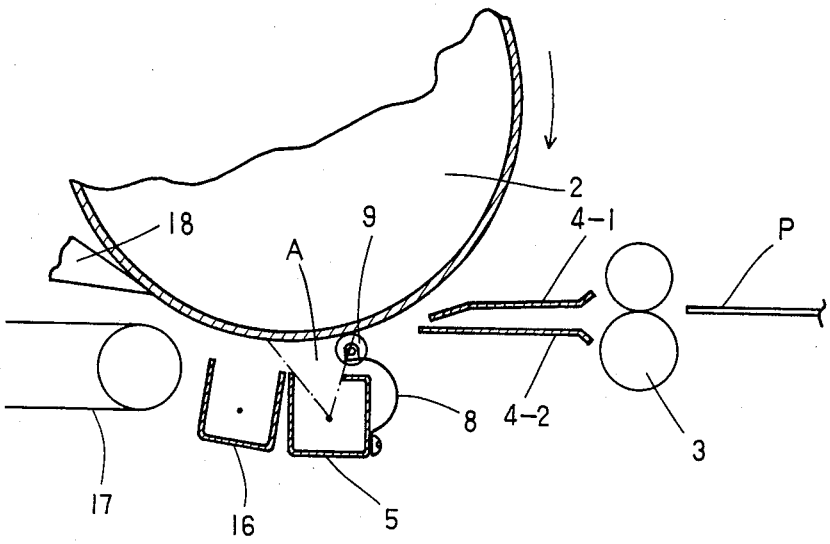
FIG. 9 is a schematic view of a further modification of the image transferring station and surrounding components in the transfer type image information apparatus, according to the present invention.
Figure 10:
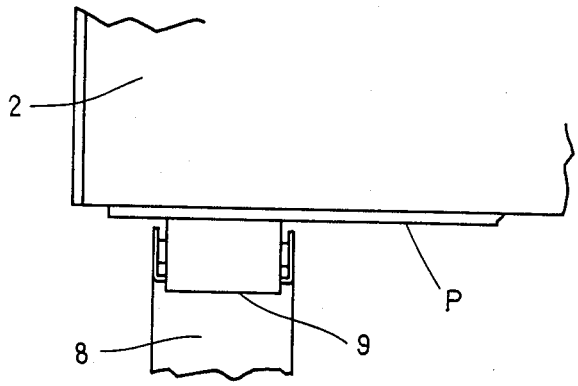
*FIG. 10 is a side view of the modification shown in* FIG. 10.

FIGS. 9 and 10 show another modification of the present invention in which the transfer station roller 9 is mounted on the transfer charger 5 through a resilient support member 8. The transfer station roller 9 is of the constant diameter along the length thereof. This modification has an electrostatic separation type separation means which comprises an electrostatic separation charger 16, a conveying belt 17 for carrying the transfer material P to the discharge station, the belt having suction means for holding the transfer material on the surface of the conveying belt, and an auxiliary separation pawl 18 contacting tangentially with the surface of the image bearing member 2. Thus, this arrangement includes no separating belt as shown by 6 in FIGS. 3 to 6. As shown in FIG. 10, a transfer material P conveyed from the register rollers 3 is gripped between the image bearing member and the transfer station roller 9 to bring the transfer material into good contact with the image bearing member 2, so that the transfer step can be carried out in a good state to obtain an image of higher quality.

Where the transfer station roller 9 having the constant diameter along the length thereof is used as in FIGS. 9 and 10, the pressure in the transfer station roller 9 may directly be applied to the transfer material independently of the thickness thereof. This may cause a distortion in the transfer material if it is of a reduced thickness. On the contrary, the stepped roller 9 shown in FIGS. 3 to 6 will not cause any distortion in the transfer material P since the increased diameter portion 9*a* engages the image bearing member 2 while the intermediate or reduced diameter portion 9*b* or 9*c* engages the transfer material P. This transfer station roller 9 may be applied to a variety of transfer materials fallen within the broad range of thickness.

In a further aspect, the transfer station roller 9 may be disposed to act on the transfer material P at a point immediately after the latter has passed the transfer charger 5, as shown by broken line in FIG. 3.

What is claimed is:

1. A transfer station alignment device comprising:

an image bearing member for bearing an image to be transferred;

means for transferring the image on said image bearing member onto a transfer material in the form of a sheet;

means for separating said transfer material from said image bearing member at a marginal region; and a rotary member located upstream of said transferring means with respect to the direction of movement of said transfer material to make a rolling contact with said image bearing member and to grip the transfer material between itself and said image bearing member.

2. A transfer station alignment device as defined in claim 1 wherein said rotary member contacts the surface of said image bearing member in the non-imaging region and wherein a clearance is formed between the surface of said image bearing member and the surface of said rotary member in the imaging region.

3. A transfer station alignment device as defined in claim 1 wherein said rotary member is in contact with said image bearing member through a resilient member.

4. A transfer station alignment device as defined in claim 1 wherein said apparatus is divisible into two portions one of which is pivoted to its open position and wherein said rotary member is positioned in place when said one portion is in its closed position.

5. A transfer station alignment device, comprising:

an image bearing member for bearing an image to be transferred;

means for transferring the image on said image bearing member onto a transfer material in the form of a sheet;

means for separating the transfer material from said image bearing member at a marginal region;

means for guiding the transfer material to said image bearing member;

a rotary member for pressing the transfer material to said image bearing member, said rotary member being disposed between said guiding means and said tranferring means; and means for applying pressure to said rotary member to grip the transfer material between said rotary member and said image bearing member.

6. A device according to claim 5, wherein said rotary member is supported on said guiding means.

7. A device according to claim 5, wherein said rotary member is supported on said transferring means.

* * * * *